United States Patent [19]

Massa

[11] 4,107,659

[45] Aug. 15, 1978

[54] INTRUSION ALARM SYSTEM WITH IMPROVED AIR TURBULENCE COMPENSATION

[75] Inventor: Donald P. Massa, 280 Lincoln St., Hingham, Mass. 02043

[73] Assignees: Fred M. Dellorfano, Jr.; Donald P. Massa, both of Cohasset, Mass. ; Trustees of The Stoneleigh Trust

[21] Appl. No.: 683,548

[22] Filed: May 5, 1976

[51] Int. Cl.[2] ..... G08B 13/16

[52] U.S. Cl. ..... 340/552; 343/7.7; 343/100 CL

[58] Field of Search ..... 340/258 A; 343/7.7, 343/100 CL

[56] References Cited

U.S. PATENT DOCUMENTS

| | | | |
|---|---|---|---|
| 3,111,657 | 11/1963 | Bagno | 340/258 A |
| 3,153,237 | 10/1964 | Lakatos | 343/100 CL |
| 3,631,490 | 12/1971 | Palmieri | 343/100 CL |
| 3,882,303 | 5/1975 | Linder | 343/7.7 |
| 3,885,234 | 5/1975 | Fujimoto | 340/258 A |
| 3,925,773 | 12/1975 | Green | 343/7.7 |
| 3,942,178 | 3/1976 | Hackett | 340/258 A |

*Primary Examiner*—David L. Trafton

[57] ABSTRACT

A mathematical analysis reveals the existence of circular motion in the head of a rotating phasor which represents the received signal in a Doppler intrusion alarm system in the presence of a moving target. The circular motion is virtually nonexistent when a moving target is absent regardless of the presence of environmental disturbances such as air turbulence and noise transients. The mathematical revelations are confirmed by a considerable amount of experimental data representing hundreds of thousands of measurements under various environmental conditions. The invention makes use of these new findings in combination with a new signal processing system which incorporates a circle detector for recognizing the presence of circular motion in the head of a rotating phasor when it occurs in the received signal, thus permitting absolute detection of a moving target even in the presence of environmental disturbances, such as air turbulence, while the system remains immune to false alarms due to these disturbances. The use of digital circuitry eliminates the need for sensitivity controls such as are required in prior art systems, thereby insuring correct installation of the inventive system with maximum reliability of operation.

18 Claims, 20 Drawing Figures

INTRUSION ALARM SYSTEM WITH IMPROVED AIR TURBULENCE COMPENSATION

This invention is related to and is an extension of my co-pending application Ser. No. 486,673 filed July 8, 1974, now U.S. Pat. No. 3,967,260, and it is also related to U.S. Pat. No. 3,828,336. It is concerned with an ultrasonic intrusion detection system in which a moving target is detected by means of a Doppler shift in the transmitted ultrasonic frequency caused by the motion of the target. More specifically, this invention is concerned primarily with the elimination of false alarms which generally occur in the presence of air turbulence.

The principle of operation of an ultrasonic intrusion detection system is well known and is more fully described in U.S. Pat. No. 3,828,336 and in the co-pending application Ser. NO. 486,673, now U.S. Pat. No. 3,967,260, wherein also various state of the art patents are fully discussed together with a comprehensive analysis of the various problems which still prevent the prior art systems from being immune to false alarms in the presence of air turbulence. My co-pending application gives a detailed description of a new processing system which eliminates false alarms caused by air turbulence, which is the major failing of the prior state of the art systems.

This present application is an extension of the fundamental principles disclosed in my co-pending application and describes an expanded and more versatile electronic processing system than was previously disclosed. I have discovered in my continuing investigations that there exists in ultrasonic intrusion alarm systems two zones of detection that hitherto were not recognized. I have identified these two zones as the "near field" zone of detection and the "far field" zone of detection. A detailed description and definition of these two zones will be given later.

The novel system described in my co-pending application 486,673 is basically a near field processing system. This present application extends the teachings of my co-pending application and describes an improved signal processing system which is also effective for detection in the far field without being subject to false alarms due to air turbulence.

This invention describes a novel method for eliminating false alarms due to air turbulence in an ultrasonic intrusion detection system without reducing the sensitivity or detection capability of the system, and is based on a fundamental and complete understanding of the effects of air turbulence on the acoustic system. All the prior art disclosures previous to U.S. Pat. No. 3,828,336 have assumed that if the air in the room is moving it will cause a large Doppler shift in the frequency of the transmitted signal, as was originally and erroneously assumed from the early experimental data presented in FIG. 3 of U.S. Pat. No. 2,794,974. This previous assumption, which has been retained as a correct premise in the subsequent prior art patents, is erroneous because, as more fully explained in my co-pending application, the moving air will only cause variations in the velocity of sound (the air velocity is added to the sound velocity) without causing any time rate of change in effective path length between the transmitter and receiver which, as is well known, is a basic requirement for producing a Doppler shift. The moving air can, under conditions of rapid changes in velocity, cause very low frequency shifts in the individual components of the received signal. These frequency shifts are generally less than 2 Hz, even for very rapid changes in air velocity, as is fully described in the derivation of equation (19) in my co-pending application.

This invention is based on a thorough and comprehensive understanding of the interaction of acoustic waves reflected from various objects in the presence of air turbulence. Applicant has discovered that there exists in a Doppler intrusion alarm system two previously unrecognized zones of detection; a "near field" zone in which the received sound pressure from the object in motion is greater than the received sound pressure from all other sources, and a "far field" zone in which the received sound pressure from the object in motion is less than the received sound pressure from all other sources. Applicant's recognition of the existence of these two zones now makes it possible the novel design of the improved processing system herein disclosed which is immune to false alarms and does not have the well known limitations of the contemporary prior art systems which are more fully discussed in my co-pending application. This invention described an improved intrusion alarm system that achieves greatly increased reliability over prior art systems, is immune to false alarms in the presence of air turbulence, and is immune to false alarms in the presence of acoustic and electrical noise transients.

The primary object of this invention is to improve the reliability of ultrasonic intrusion alarm systems.

Another object of this invention is to greatly reduce false alarm rates in ultrasonic alarm systems in the presence of air turublence without reducing the sensitivity or detection capability of the system.

A still further object of this invention is to greatly reduce false alarm rates in ultrasonic alarm systems in the presence of air turbulence without introducing long time delays in the detection circuit.

Another object of this invention is to greatly reduce false alarm rates in ultrasonic intrusion alarm systems in the presence of air turbulence by utilizing the knowledge gained from a newly recognized "near field" and "far field" zone of detection that exists in a Doppler intrusion alarm system.

A further object of this invention is to simplify the signal processing system, thereby reducing the complexity of the system with a corresponding increase in the reliability of the system together with a decrease in manufacturing costs.

Another object of this invention is to introduce digital circuitry in the alarm system which permits the elimination of adjustment controls and results in simpler installation and increased immunity to false alarms in the presence of transients in the system.

A still further object of this invention is to employ a microprocessor in the system to provide means for the continuous high speed sampling, storing and analyzing of the received signal data to very greatly improve the moving target recognition capability of the system in the presence of air turbulence and noise transients thereby achieving increased immunity to false alarms over the prior art.

These and other objects, features, and advantages of the invention will become more fully apparent from the following detailed description taken in conjunction with the accompanying drawings, in which.

MATHEMATICAL MODEL FOR AN ULTRASONIC INTRUSION ALARM SYSTEM

Figure 1:
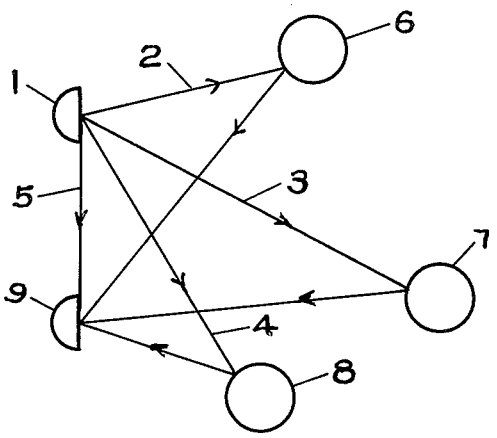
FIG. 1 is a schematic diagram illustrating various paths along which sound waves travel between the transmitter and the receiver in a typical ultrasonic intrusion alarm installation.

The pressure wave appearing at the receiver of an ultrasonic intruder alarm system is the summation of all the pressure waves arriving from all reflecting objects as well as the pressure wave arriving by a direct transmission path. The received pressure wave is defined in equation (1) of co-pending application No. 486,673 as follows:

$$p(t) = \sum_i A_i e^{j\left[\omega_c t - \frac{\omega_c R_i(t)}{c_i(t)}\right]} \quad (1)$$

where:

$p(t)$ is the pressure wave at the receiver $A_i$ is the amplitude of the $i^{th}$ component $\omega_c$ is the transmitted frequency $R_i(t)$ is the total distance traversed by the $i^{th}$ component of the pressure wave in travelling from the transmitter to the receiver. This distance becomes a function of time if the transmitter, receiver, or reflector is moving $c_i(t)$ is the speed of sound along the path of the $i^{th}$ component of the pressure wave which becomes a function of time in the presence of air turbulence Equation (turbulence) of my co-pending application shows that intense air turbulence will cause a frequency shift of less than 2 Hz on any term of equation (1) if the transmitted frequency is 20 kHz. Equations (11) and (13) in the co-pending application show that the Doppler frequency shift caused by a target moving at 1 ft/sec. is 36 Hz. However, the original data shown in FIG. 3 of U.S. Pat. No. 2,794,974 indicates measured frequency shifts as high as 100 Hz in the presence of air turbulence, which were erroneously assumed to be Doppler frequency shifts. This erroneous assumption has been accepted without challenge in all subsequent patents or ultrasonic intrusion alarms as discussed in greater detail in my co-pending application. These originally reported frequency shifts were not Doppler shifts, as was stated in the previous patents, but were caused by the many different sound reflections from different stationary objects which arrive at the receiver in rapidly changing phase relationships as the instantaneous sound speed varies along each different path as a result of the moving air. It is very important to understand the exact interaction between these acoustic waves in the presence of air turbulence in order to properly design an alarm system which will not be affected by air turbulence. Therefore, a mathematical analysis will be given to provide this basic understanding before the details of Applicant's novel processing system are disclosed.

The pressure wave defined by equation (1) is a complex expression which may be represented graphically by a summation of rotating sound pressure phasors in the complex plane. This method of representing the complex quantity $e^{j\omega t}$ by a rotating phasor in a coordinate system in which the horizontal axis is the real axis and the vertical axis is the imaginary axis is well known in the art. It is based on the well known relationship as represented in Euler's formula $$Ae^{\pm j\omega t} = A\cos\omega t \pm jA\sin\omega t \quad (2)$$

The phasor representing the quantity $Ae^{j\omega t}$ is a vector of magnitude A whose angle is $\omega t$. As time increases, $\omega t$ increases and the vector rotates.

When manipulating phasors, vector algebra is used. A detailed analysis of the representation of sinusoidal signals in terms of phasors is given in the book *Linear*

*Circuits* by Ronald E. Scott, published by Addison-Wesley Publishing Company, Inc., Reading, Mass., 1960.

Each term of equation (1) may be represented by a phasor of magnitude $A_i$, and each making an angle $\phi_i(t)$ with the real axis where $$\phi_i(t) = \omega_c t - \frac{\omega_c R_i(t)}{c_i(t)} \quad (3)$$

which can be written:

$$\phi_i(t) = \omega_c t + \phi_i'(t) \quad (3a)$$

where:

$$\phi'_i(t) = -\frac{\omega_c R_i(t)}{c_i(t)}$$

It can be seen that the phase angle $\phi_i(t)$ changes as a function of time thus causing the phasors to rotate. At any instant of time, the phasors are stationary and can be added together as vectors. The summation phasor of the vector addition of all of the component phasors represents $p(t)$ in equation (1), which is the total sound pressure at the receiving microphone.

Figure 2:
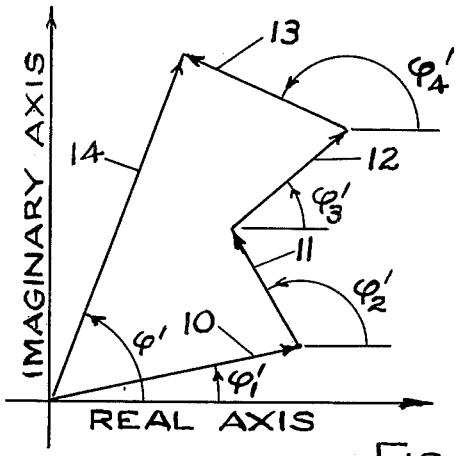
FIG. 2 is a phasor diagram representing the total pressure summation of the separate component sound pressure phasors arriving at the receiver along the several paths illustrated in FIG. 1.

FIG. 1 illustrates a typical situation encountered in an ultrasonic intrusion alarm installation. A transmitter 1 sends out sound energy along the various paths 2, 3, 4 and 5. Some of the energy is reflected by the stationary objects 6, 7 and 8 within the room; and after reflection arrives at the receiving transducer 9 as illustrated. Additionally, some of the sound arrives at the receiver by the direct path 5 from the transmitter without reflection. The total sound pressure at the receiver is the summation of all of the acoustic waves that arrive at the receiver, as is given by equation (1). For the particular case illustrated in FIG. 1, there are three reflecting targets plus one direct sound path, so there will be four sound pressure waves arriving simultaneously at the receiver. The amplitude and phase of each wave will be a function of the total path length the sound travels, the frequency of the sound, the speed of sound, and the reflecting characteristics of the targets. For the particular situation illustrated in FIG. 1 when the path lengths $R_i(t)$ and the sound speed $c_i(t)$ are constant, equation (1) will have four terms and becomes:

$$p(t) = A_S e^{j(\omega_c t + \phi')} = A_1 e^{j(\omega_c t + \phi_1')} + A_2 e^{j(\omega_c t + \phi_2')} + A_3 e^{j(\omega_c t + \phi_3')} + A_4 e^{j(\omega_c t + \phi_4')} \quad (4)$$

which can be written:

$$p(t) = e^{j(\omega_c t)} (A_1 e^{j\phi_1'} + A_2 e^{j\phi_2'} + A_3 e^{j\phi_3'} + A_4 e^{j\phi_4'}) \quad (4a)$$

where:

$\phi'$ is the relative phase of the received wave as compared with the phase of the electrical voltage applied to the transmitting transducer which is taken as a reference $A_S$ is the magnitude of the total received signal phasor A graphical representation of the total pressure summation in equation (4) is shown in FIG. 2. The four rotating component phasors 10, 11, 12, and 13 have amplitudes $A_1$, $A_2$, $A_3$ and $A_4$, and represent respectively the reflections from the objects 6, 7 and 8, plus the direct sound path 5. Each of these phasors is rotating at an angular frequency $\omega_c$ as can be seen from the phase terms of equations (4) and (4*a*). The particular instant of time that was chosen for the representation in FIG. 2 is such that $\omega_c t = 2n\pi$, where $n = 0, 1, 2, 3$, etc. so that the term $e^{j(\omega_c t)}$ of equation (4*a*) will be equal to one. Under these particular conditions $\phi_i'(t)$ of equation (3*a*) will be equal to $\phi_i'$ of equations (4) and (4*a*). Phasor 14 is the summation of the four sound pressure phasors which are arriving at the receiving transducer 9 and it is also rotating at an angular frequency $\omega_c$. The actual sound pressure that is measured and transformed into an electrical signal by receiver 9 is a sinusoidal function as represented by the real portion of the complex expression $A_S e^{j(\omega_c t + \phi')}$ given in equation (4). From equation (2) it follows that $$A_S e^{j(\omega_c t + \phi')} = A_S \cos(\omega_c t + \phi') + jA_S \sin(\omega_c t + \phi') \quad (5)$$

The real portion of equation (5), $A_S \cos(\omega_c t + \phi')$, represents the actual instantaneous value of the sound pressure asa function of time at the receiver 9, which may be represented graphically by the projection of the total rotating phasor 14 in FIG. 2 on the real axis as it rotates about the origin at the angular frequency of $\omega_c$.

The phasor diagram of FIG. 2 represents the particular instant of time when the phase of the electrical voltage applied to the transmitting transducer is zero degrees. Since the total rotating phasor 14 is rotating at a constant speed, $\omega_c$, it follows that its projection on the real axis will be a sinusoidal function of time. If there is no movement within the room and the sound velocity remains constant, then both the amplitude $A_S$ and relative phase $\phi'$ of the received pressure wave will be constant.

If a moving target now enters the area, a new phasor will be added to the received pressure wave. The new total received pressure wave, $p_M(t)$, is expressed by $$p_M(t) = A_S e^{j(\omega_c t + \phi')} + A_M e^{j(\omega_c t - \frac{\omega_c R_M(t)}{c})} \quad (6)$$

where:

$A_M$ is the amplitude of the pressure wave arriving from the moving target $R_M(t)$ is the total path length of the acoustic wave from the transmitter to the moving target to the receiver Since the total path length from the transmitter to the moving target to the receiver, $R_M(t)$, is varying with time, the rate of change of path length is $$\frac{d R_M(t)}{dt}$$

and equation (6) can be rewritten in the form $$p_M(t) = A_S e^{j(\omega_c t + \phi')} + A_M e^{j[(\omega_c + \Delta\omega)t - \frac{\omega_c R_M}{c}]} \quad (7)$$

where:

$\Delta\omega$ is the change in frequency caused by the motion of the target and is equal to $$-\frac{\omega_c}{c}\left(\frac{d R_M(t)}{dt}\right)$$

Figure 3:
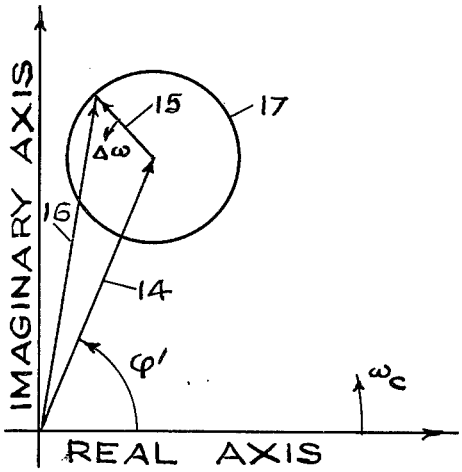
FIG. 3 is a graphical representation of the total summation phasor of FIG. 2 combined with an additional component phasor which reaches the receiver when a moving target is introduced into the sound field.

$R_M$ is the initial acoustic path length from the transmitter to the target to the receiver when the target begins to move FIG. 3 is a graphical representation of equation (7) in the complex plane and contains the total phasor 14 prepresenting reflections from the stationary objects, as illustrated in FIG. 2, plus a rotating component phasor 15 which is the graphical representation of the second term of equation (7) and corresponds to the reflection from the moving target. The new total rotating phasor 16 is the vector summation of 14 and 15. In FIG. 3 the coordinate system is represented as rotating at an angular frequency of $\omega_c$. Therefore, a phasor which rotates at an angular frequency of $\omega_c$, such as is represented by the phasor 14, will remain stationary relative to this coordinate system. However, a phasor such as 15, as represented by the second term in equation (7), which has a frequency different from $\omega_c$, will rotate relative to the coordinate system at a rate $\Delta\omega$. The head of the phasor 15 will therefore trace a circle 17 as shown in FIG. 3. The locus of the head of the total rotating phasor 16 will follow the head of component phasor 15 and it will also describe the same circular path 17 as shown in FIG. 3.

NEAR FIELD AND FAR FIELD CONDITIONS

It can be deduced from FIG. 3 that two distinct cases are possible for the diagramatic phasor representation of the conditions which can occur in a typical acoustic environment. The first condition occurs when the amplitude, $A_M$, of the moving target phasor 15 is less than the amplitude, $A_S$, of the stationary target phasor 14; that is the amplitude of the received sound pressure reflected from the moving target is less than the amplitude of the received sound pressure reflected from all the stationary objects within the room. This situation will be defined as the "far field" condition. The second condition occurs when $A_M$is greater than $A_S$; that is, the amplitude of the recieved sound pressure relfected from the moving target is greater than the amplitude of the received sound pressure reflected from all the stationary objects within the room. This will be defined as the "near field" condition. The illustration in FIG. 3 is representative of the "far field" condition.

Figure 4:
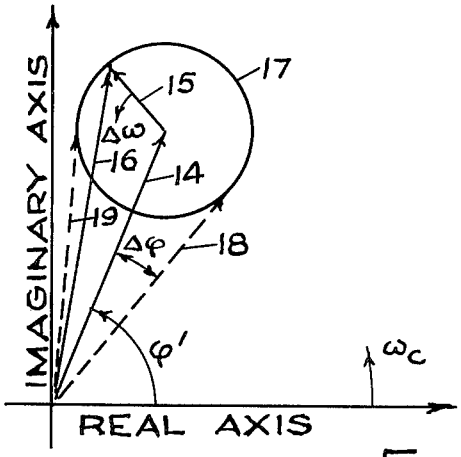
FIG. 4 is a repetition of the phasor diagram of FIG. 3 with the addition of two dotted phasors illustrating the maximum limits of angular displacement of the total combined phasor which occurs as a result of the presence of the moving target.

Another representation of the "far field" condition is shown in FIG. 4 in which the phasor diagram of FIG. 3 is repeated with the addition of the two dotted phasors 18 and 19 drawn tangent to the circle 17 created by the rotation of the moving target phasor 15. The two dotted phasors represent the two values of the total rotating phasor 16 at the maximum limits of angular displacement $\pm\Delta\phi$ which occurs as phasor 15 rotates about phasor 14. Since the moving target phasor 15 is rotating at a rate of $\Delta\omega$, the total rotating phasor 16 will be a phasor whose tail is at the origin and whose head traces the circle 17, as shown in FIGS. 3 and 4, created by the head of the rotating phasor 15. It is evident that the amplitude of the total rotating phasor 16 varies between the magnitudes $|A_S + A_M|$ and $|A_S - A_M|$ while the phase varies between $\phi+\Delta\phi$ and $\phi-\Delta\phi$. The average frequency of the total rotating phasor 16 for the "far field" condition illustrated in FIG. 4 is $\omega_c$. The phase difference between the phasors 16 and 14 varies between the limits $\pm\Delta\phi$. The maximum phase difference can therefore be defined as $$\Delta\phi = \sin^{-1}\left(\frac{A_M}{A_S}\right) \tag{8}$$

Figure 5:
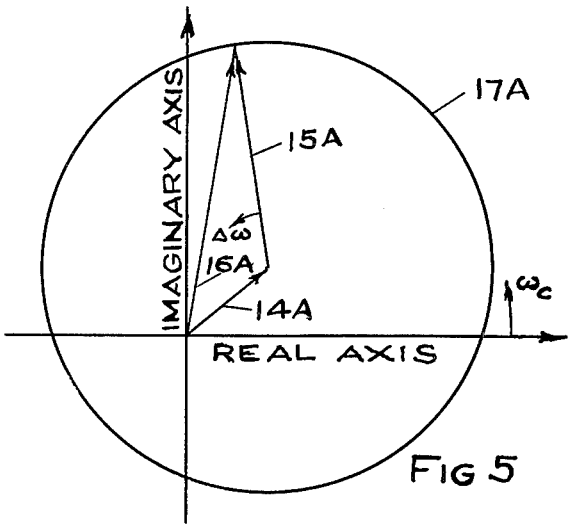
FIG. 5 illustrates the phasor diagram of FIG. 3 when the amplitude of the moving target phasor is greater than the amplitude of the total summation phasor resulting from the stationary target conditions as illustrated in FIG. 2.

FIG. 5 illustrates the "near filed" condition in which the amplitude, $A_M$, of the moving target phasor 15A is greater than the amplitude, $A_S$, of the stationary target phasor 14A. For this condition the head of the rotating phasor 15A will trace the circle 17A which results in a 360° phase shift between the total rotating phasor 16A and the stationary target phasor 14A each time the moving target phasor 15A makes one complete revolution around the stationary target phasor 14A. If the target is moving towards the receiver, the frequency of the sound being reflected from the target will be greater than the frequency of the transmitted sound, as shown in equation (11) of my co-pending application. Therefore the moving target phasor 15A will be rotating at a higher frequency than the stationary target phasor 14A which means that 15A will rotate counterclockwise at the rate of $\Delta\omega$ in FIG. 5. Each time 15A makes one revolution around 14A, the total rotating phasor 16A will gain one cycle over the stationary target phasor 14A; thus the average frequency of the phasor 16A will be $\omega_c + \Delta\omega$, which corresponds to the frequency of the sound being reflected from the moving target. In other words, if a target in the near field moves towards the receiver, the average frequency of the received sound pressure wave will be increased over the frequency of the transmitted signal by $\Delta\omega$. In like manner, if the target is moving away from the receiver, the received frequency of the sound being reflected from the target will be less than the frequency of the transmitted sound, as shown in equation (13) of the co-pending application. For this condition the moving target phasor 15A will rotate clockwise at a rate of $\Delta\omega$ thus causing the total rotating phasor 16A to lose one cycle compared to the stationary target phasor 14A each time 15A makes on revolution around 14A; thus the average frequency of the received signal will decrease from the frequency of the transmitted signal and becomes $\omega_c - \Delta\omega$.

Figure 6:
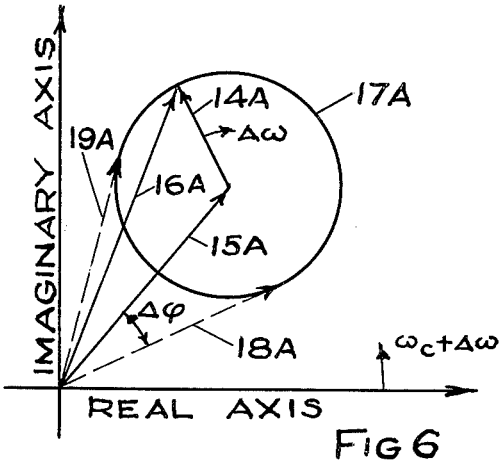
FIG. 6 represents the same data shown in FIG. 5 except that the coordinate system is modified to rotate at an angular frequency $\omega_c + \Delta\omega$.

FIG. 6 shows the near field condition of FIG. 5 except that the coordinate system is modified to rotate at an angular frequency of $\omega_c + \Delta\omega$. In such a coordinate system, the moving target phasor 15A will appear stationary, and the stationary target phasor 14A will appear to rotate clockwise around the head of phasor 15A at a rate of $\Delta\omega$. The modified representation of the near field condition as shown in FIG. 6 now appears similar to the far field representation depicted in FIG. 4. The average frequency odf the total phasor 16A in FIG. 6 is $\omega_c + \Delta\omega$. The phase difference between the phasors 16A and 15A varies between the limits $\pm\Delta\phi$ as 14A revolves around 15A.

An analysis of FIGS. 4 and 6 shows that the received signal as represented by the total phasor 16 and 16A will be amplitude modulated in both the "far field" condition depicted in FIG. 4 and the "near field" condition depicted in FIG. 6 because the phasor amplitude varies between the limits $|A_S + A_M|$ and $|A_S - A_M|$ in both cases. It is only in the near field condition, however, as represented in FIGS. 5 and 6, that the average frequency of the received signal differs from the frequency of the transmitted signal. Therefore, a signal processing system of the type disclosed in my co-pending application No. 486,673 which eliminates the effects of amplitude modulation in the received signal only detects changes in frequency in the received signal and will operate effectively only in near field conditions.

EFFECTS OF AIR TURBULENCE

The effects of air turbulence can now be better understood by utilizing the math models presented in this disclosure. Referring to FIG. 2, the phasor 14 represents the received signal comprising the summation of the rotating component phasors 10, 11, 12 and 13, which in turn represent the several reflections from the stationary targets 6, 7 and 8 plus the direct sound path 5 shown in FIG. 1. In still air, the total phasor 14 is constant in frequency and amplitude. However, in the presence of air turbulence, each of the component phasors will change in phase in a random manner at a rate corresponding to a maximum frequency shift of approximately 2 Hz as derived in equation (19) of my co-pending application.

In the presence of air turbulence the component phasors in FIG. 2 will change randomly in phase in both positive and negative directions. As a result, the summation phasor 14 will change randomly in both amplitude and phase.

In a typical intrusion detection system numerous reflecting targets are present and since, on the average, at any instant of time, as many component phasors will be rotating in a positve direction as will be rotating in a negative direction the summation phasor 14 will statistically seldom be able to rotate a full 360° and therefore the average frequency of the summation phasor remains constant and equal to the transmitted frequency.

Applicant has obtained experimental verification of the math model of the intrusion alarm system disclosed in this application. A special circuit including a real time computer processing system was built to measure and record the instantaneous variations in the amplitude of the received signal and the phase of the received signal relative to the phase of the voltage applied to the transmitting transducer. The curves are therefore plots of the locus of the head of the total rotating phasor. The recorded data was analyzed and plotted on an X-Y recorder.

Figure 7:
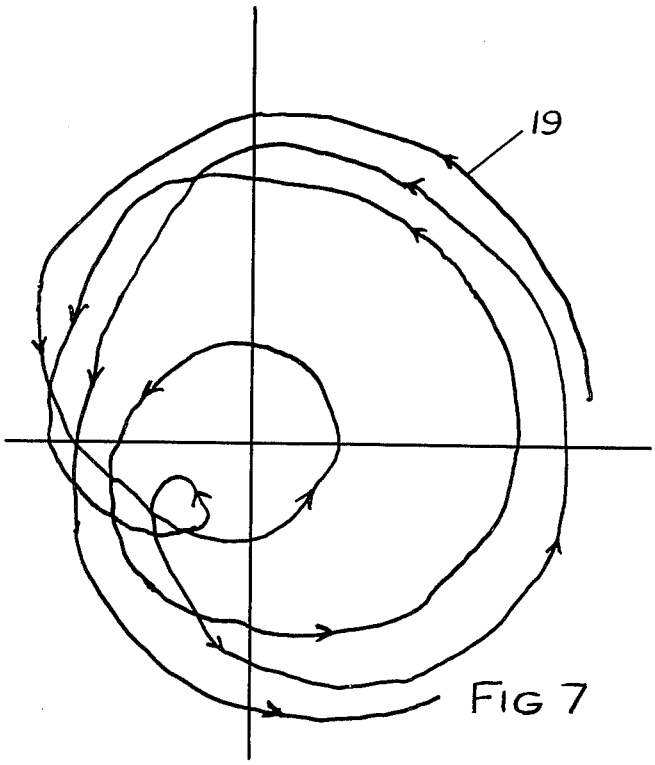
FIG. 7 shows a plot of the actual experimental data as recorded while a human target was walking toward the receiving transducer in the "near field" region.
Figure 8:
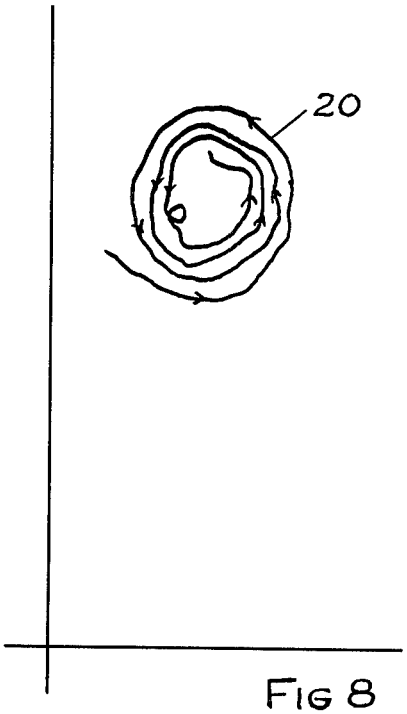
FIG. 8 shows the experimental data as measured while a human target was walking toward the receiving transducer in the "far field" region.
Figure 9:
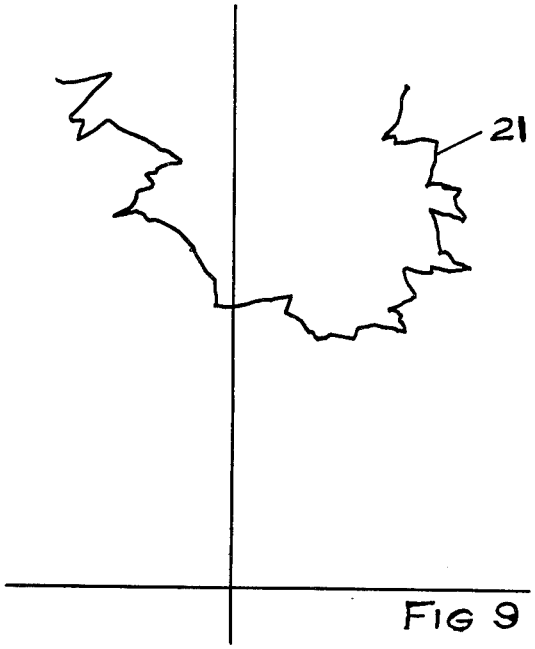
FIG. 9 shows the measured experimental data as recorded during heavy air turbulence in the absence of a moving target.
Figure 10:
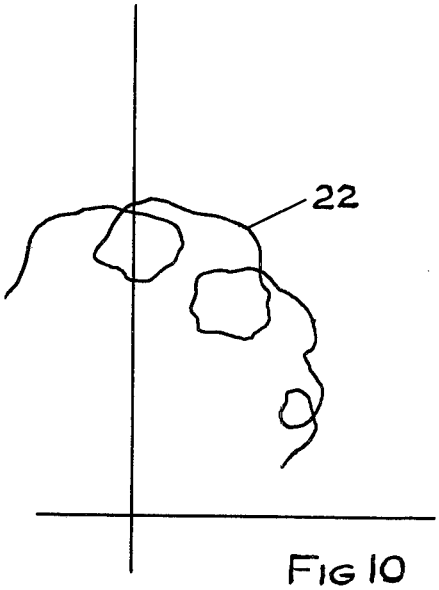
FIG. 10 shows a plot of the experimental data as measured during heavy air turbulence in the presence of a moving human target walking in the "far field" region.

The experimental data are shown in FIGS. 7, 8, 9 and 10. The quasi-circular paths which are evident in FIGS. 7, 8 and 10 are caused by the presence of a moving target. The slight irregularities appearing in the quasi-circular paths result from the varying reflection characteristics of the target as it moves.

FIG. 7 shows the curve 19 as actually plotted from the experimental data which was measured while a human target was walking toward the receiver in the near field region. Curve 19 shows the quasi-circular path described by the locus of the head of the total rotating phasor which is in complete agreement with the circular path predicted by the math model as shown in FIG. 5. Curve 19 also shows that the locus of the head of the rotating phasor is increasing in phase at the rate of 360° per revolution about the origin which, in turn, results in an increase in frequency in the near field received signal thus giving further experimental confirmation to the conclusions derived from the math model as discussed in connection with FIG. 5.

FIG. 8 shows the actual measured experimental data as recorded while a human target was walking toward the receiver in the far field. The quasi-circular motion of the locus of the head of the total rotating phasor indicated in curve 20 can be seen to be similar to the circular path 17 indicated in the illustrations of FIGS. 3 and 4, which confirms the prediction of the math model in the far field.

FIG. 9 shows the actual experimental data as plotted during heavy air turbulence in the absence of a moving target. As can be seen from curve 21 there is complete random motion of the locus of the head of the total rotating phasor which is changing randomly in both amplitude and phase as predicted, thus confirming the predictions of the math mode. It is also evident from FIG. 9 that air turbulence causes neither the quasi-circular motion of the phasor present in FIG. 8, nor the change in frequency shown in FIG. 7 thus further confirming the conclusions drawn from the math model.

FIG. 10 shows the recorded experimental data during heavy air turbulence in the presence of a human target walking in the far field. Curve 22 clearly shows the quasi-circular motion of the phasor caused by the moving target in the far field (as represented by curve 20 in FIG. 8) superimposed on the random motion of the phasor caused by air turbulence (as represented by curve 21 in FIG. 9). Experimental curve 22 further confirms that the locus of the head of the total rotating phasor describes a quasi-circular path even in the presence of air turbulence.

The experimental data shown in FIGS. 7, 8, 9 and 10 confirm the conclusions derived from the math model; namely, the quasi-circular motion in the head of the total rotating phasor will always occur in the presence of a moving target whether or not air turbulence is present and that the presence of air turbulence alone causes the locus of the head of the total rotating phasor to move only in a completely random pattern.

GENERAL DESCRIPTION OF AN ALARM SYSTEM UTILIZING THE TEACHINGS OF THIS INVENTION

Figure 11:
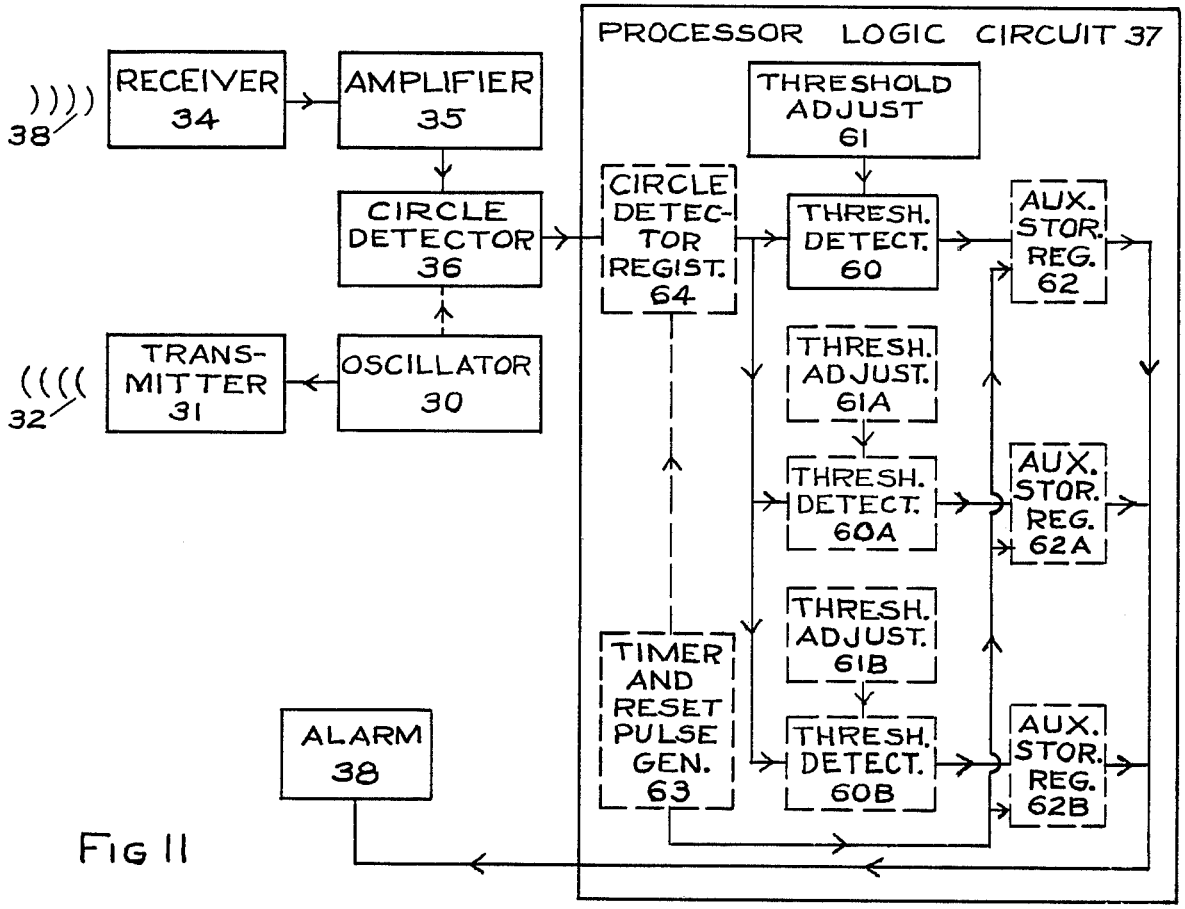
FIG. 11 is a schematic block diagram illustrating the improved intrusion alarm system employing the teachings of this invention.

FIG. 11 is a schematic block diagram illustrating an intrusion alarm system which utilizes the teachings of this invention. An oscillator 30 generates an ultrasonic signal which is connected to the electroacoustic transmitting transducer 31. In the case of a large installation where several transducers may be employed to adequately cover the area, transmitting transducer 31 may be one of several transducers connected in parallel. An acoustic signal 32 is produced by the transducer 31, and after it is reflected by any stationary or moving targets, it is received by the receiving transducer 34. The received signal 32 may be represented by the phasor summation of all the reflected pressure waves plus the direct pressure wave arriving at the receiving transducer 34. The characteristics of the received signal 33 are expressed by the relationship shown in equation (1) and further discussed in connection with the test referring to FIGS. 2-10. The received acoustic signal 33 is converted to an electrical signal by the transducer 34, and is then amplified by the amplifier 35, after which it is fed into a circle detector 36. If the circle detector is one which requires a reference signal corresponding to the carrier frequency, the reference signal is provided by the oscillator 30 as illustrated by the dotted line between oscillator 30 and circle detector 36.

The circle detector 35 performs the basic function described in this invention; that is, to detect a moving target both in still and in the presence of air turbulence in either the near field or far field as described previously in this application. It accomplishes its function by detecting the presence of a quasi-circular path in the movement of the head of the total rotating phasor signal picked up by the receiving transducer 34. The signal from the circle detector 36 is fed into the processor logic circuit 37. This circuit analyzes the output of circle detector 16 and determines whether or not this output indicates the presence of a moving target. Several different embodiments of the circle detector 36 and processor logic circuit 37 will be described which utilize well known circuit concepts for accomplishing the novel signal processing disclosed. The individual circuit techniques to be described are well known in the electronic art and are not in themselves part of this invention. This invention is only concerned with the novel data processing system as herein disclosed for recognizing the newly-discovered quasi-circular motion that has been found to exist mathematically and confirmed experimentally in the path of the head of the total received phasor when this quasi-circular motion is present due to a moving target as described, and then activating the alarm circuit 38.

CIRCLE DETECTOR USING AUTO-CORRELATION OF THE PHASE OF THE RECEIVED SIGNAL

Figure 12:
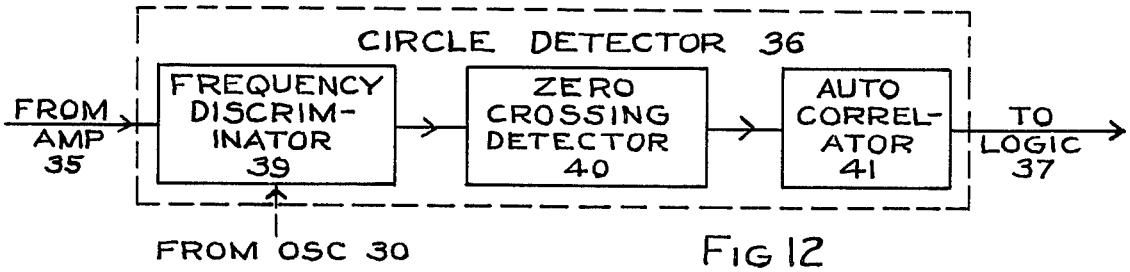
FIG. 12 is a schematic diagram illustrating one type of design for the circle detector shown in FIG. 11.

FIG. 12 is a schematic block diagram illustrating the use of a frequency discriminator and an auto-correlator as the circle detector 36 of FIG. 11. The signal from amplifier 35 is fed into a frequency discriminator 39 which is a well known device whose output voltage varies as a function of the instantaneous frequency of the input signal. The frequency discriminator 39 may be any one of the types well known in the electronic art, such as the FM detector described in my co-pending application or any of the variety of discriminators described on page 508 in the textbook *Signals, Systems, and Communication,* by B. P. Lathi, published by John Wiley and Sons, Inc., New York, 1965. If a reference signal from the oscillator 30 is required by the frequency discriminator 39, it is provided as indicated by the dotted line in FIG. 12.

The output voltage from the frequency discriminator 39 will move in a positive direction when the instantaneous frequency of the received signal is increasing with time and in a negative direction when the instantaneous frequency is decreasing with time. When a moving target is present, the phase of the received signal will vary $\pm \Delta\phi$ about the average phase $\phi$ as illustrated in FIG. 4. When the phase of the total summation phasor 16 of FIG. 4 is increasing, the instantaneous frequency of the received signal is increasing, and the output voltage from the frequency discriminator 39 will be increasing in a positive direction. Likewise, when the phase of the total phasor 16 of FIG. 4 is decreasing, the instantaneous frequency of the received signal is decreasing, and the output voltage from the frequency discriminator 39 will be decreasing. The output of the frequency discriminator 39 will therefore be a voltage which is periodically increasing and decreasing at a frequency $\Delta\omega$ as the moving target phasor 15 spins about the head of the stationary target phasor 14 at a rate of $\Delta\omega$. If the voltage appearing at the output of the frequency discriminator 39 contains a DC component it may be easily removed by the use of a high pass filter in the conventional manner.

The output of the frequency discriminator 39 is then fed into the zero-crossing detector 40 which is similar to the zero-crossing detectors 31, 40 and 40A described in my co-pending application. The zero-crossing detector is a device that generates an output signal having approximately constant amplitude and whose frequency corresponds to the instantaneous frequency of the input signal. A preferred wave form for the output signal of the zero-crossing detector is a square wave.

Figure 16:
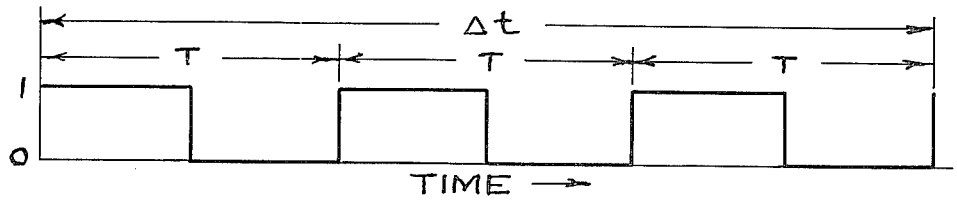
FIG. 16 illustrates the output signal generated by the zero-crossing detector of FIG. 12 in the presence of a moving target.

FIG. 16 shows a typical output signal generated by the zero-crossing detector 40 due to the presence of a moving target. The moving target phasor 15 of FIG. 4 will be rotating about the head of the stationary target phasor 14 at a rate $\Delta\omega$ which corresponds to the speed of the moving target. As the head of the phasor 16 follows the quasi-circular path 17, the phase of the received signal, as represented by the phase of the phasor 16, will increase and decrease at a frequency $\Delta f$ where $$\Delta f = \frac{\Delta\omega}{2\pi} \tag{9}$$

This means that the output of the zero-crossing detector 40 will be a square wave of frequency $\Delta f$. During discrete intervals of time the speed of an intruder will remain relatively constant, which means that the frequency $\Delta f$ will be relatively constant during the interval. However, the exact value of $\Delta f$ during any particular discrete time interval will be proportional to the particular target speed during the interval. For example, from equation (9) of my co-pending application it can be seen that the value of $\Delta f$ will be 36 Hz for a target moving at 1 ft/sec and 180 Hz for a target moving at 5 ft/sec in an alarm system using a carrier frequency of 20 kHz.

Figure 17:
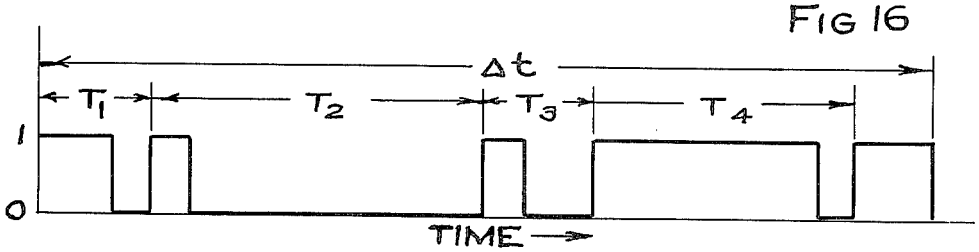
FIG. 17 illustrates the output signal generated by the zero-crossing detector of FIG. 12 in the presence of only air turbulence.

In the presence of only air turbulence without a moving target the phase of the received signal will vary in a random manner as shown by the curve 21 in FIG. 9 which represents the motion of the locus of the head of the total rotating phasor as previously described. For this condition, therefore, the output of the zero-crossing detector 40 will be a square wave whose instantaneous frequency is randomly changing as illustrated in FIG. 17.

The signal from the zero-crossing detector 40 in FIG. 12 is fed into the auto-correlator 41. An auto-correlator is a device which recognizes the presence of a quasi-periodic signal whose frequency remains approximately constant during a discrete interval of time. In order to recognize the presence of a quasi-periodic signal, the auto-correlator can electronically perform the well known classical definition of auto-correlation which is given by $$R_{ff}(\tau) = \int_{-\Delta t}^{\Delta t} f(t)f(t-\tau)\,dt \tag{10}$$

where:

$R_{ff}(\tau)$ is the auto-correlation of the function f(t)

$f(t)$ is the function being auto-correlated $\tau$ is a time delay $\Delta t$ is the discrete interval of time over which the function is being auto-correlated As can be seen from equation (10), the auto-correlation function $R_{ff}(\tau)$ is a function of time delay. The signal $f(t)$ is multiplied by a time-delayed version of itself, $f(t-\tau)$, and the result is then integrated. If the signal is periodic, then the auto-correlation function, $R_{ff}(\tau)$, will produce a large output when the time delay $\tau$ is equal to one period of oscillation, or a multiple of one period of oscillation.

For example, curve 50 of FIG. 16, which represents the output of the zero-crossing detector 40 in the presence of a moving target, is approximately periodic with a period equal to T where $$T = \frac{1}{\Delta f} \quad (11)$$

If the signal represented by curve 50 is delayed in time, the delayed signal will be synchronous and in phase with the original signal when the time delay is equal to one period of oscillation T or any multiple of one period. If such a delayed signal is multiplied by the original signal, the resultant signal will be the square of the original wave form. It is obvious from equation (10) that the integral of the resultant signal will produce a maximum value for $R_{ff}(\tau)$ when the time delay, $\tau$, is equal to zero. This maximum value will again be approached when the value of time delay, $\tau$, is equal to T, 2T, etc. For any other value of time delay different from T or a multiple of T, the value of $R_{ff}(\tau)$ will be reduced. The auto-correlator 41 of FIG. 12 will perform the function indicated in equation (10) and search for a value of time delay for which the auto-correlation function $R_{ff}(\tau)$ approaches the value of the auto-correlation function when the time delay is zero.

When a moving target is not present, the output of the zero-crossing detector 40 will not be periodic, as illustrated by curve 51 of FIG. 17. If this nonperiodic signal is delayed in time, it can neither by synchronous nor in phase with the original signal because of its non-periodic nature; therefore, the value of the auto-correlation function, $R_{ff}(\tau)$, for any value of $\tau$ different from zero will always be less than the value of the auto-correlation function when $\tau$ is equal to zero. If the signal represented by curve 51 is fed into the auto-correlator 41 of FIG. 12, the auto-correlator could never find a value of time delay for which the auto-correlation function, $R_{ff}(\tau)$, becomes as great as the value of the function when the time delay is zero.

There are many electronic systems known in the art which perform the function of auto-correlation. A description of one of them is given on pages 264–267 of the text book *Statistical Theory of Communication* by Y. W. Lee, Wiley, New York, 1960.

A digital auto-correlation system can be designed in which a signal can be sampled over a discrete time inverval, $\Delta t$, and the sampled data stored in two registers, one which is an end carry register. The auto-correlation can then be done by having circuit progressively shift the end around carry register while the other register remains unchanged, and then performing a correlation between each bit or corresponding significance in the two registers after each shift. Since in a digital system all data is reduced to a state of logic 1 or logic 0, the process of correlation is done by an exclusive NOR gate, which will produce a logic 1 when the corresponding bits are alike and a logic 0 when the corresponding bits are different.

If the signal represented by curve 50 in FIG. 16 is sampled, for example, at a rate of eight samples per period T, then the value stored in each of the two registers for the discrete time interval $\Delta t = 3T$, as illustrated in FIG. 16, will contain the following twenty-four bits of information:

1111 0000 1111 0000 1111 0000 (stationary register)
1111 0000 1111 0000 1111 0000 (end around carry register)

Each time the end around carry register shifts, the data in the most significant place is put into the least significant place of the register. Each shift of the register is equivalent to an increment of time delay. An exclusive NOR operation between each corresponding bit of the two registers will produce all logic 1 values since the corresponding bits are alike. If the end around carry register is shifted four times, the contents of the two registers will be:

1111 0000 1111 0000 1111 0000 (stationary)
0000 1111 0000 1111 0000 1111 (end around carry)

An exclusive NOR operation between the two registers will now produce all logic 0 values since all of the corresponding bits are different.

If the end around carry register is shifted four more times, which will be a total of eight time increments or one period of oscillation, T, the contents of the two registers will again be:

1111 0000 1111 0000 1111 0000 (stationary)
1111 0000 1111 0000 1111 0000 (end around carry)

An exclusive NOR operation between the two registers now will again produce all logic 1 volues since the corresponding bits are again alike. Therefore, if the stored signal is periodic, the output of the correlator will produce a large number of logic 1 values when the register has been shifted by a time delay equivalent to one period.

If the non-perodic signal illustrated by curve 51 in FIG. 17, which represents the condition when only air turbulence is present, were digitized into 24 samples over the same discret time interval $\Delta t$, the values stored in the two registers would be:

1101 0000 0000 1001 1111 1011 (stationary register)
1101 0000 0000 1001 1111 1011 (end around carry register)

An exclusive NOR operation between these two registers will produce all logic 1 values. However, if the end around carry register is shifted, an exclusive NOR performed between the two registers will never again produce all logic 1 values until the register has shifted 24 times, and thereby returned to its original starting condition. Therefore, if the stored signal is non-periodic, the output of the correlator will not produce any significant number of logic 1 values until the data in the shift register has rotated completely so that it is back to its original starting point.

Another way to perform the auto-correlation function would be to measure the length of time of each successive period of the output signal from the zero-crossing detector 40. This can easily be done, as is well known in the art, by counting the number of high-frequency clock pulses that occur during each successive period of the signal. The number of high-frequency clock pulses can be stored in a register and compared with the number of pulses counted during the next period of the signal. For example, in the case of the periodic wave from shown by curve 50 of FIG. 16, the number of high-frequency clock pulses occurring during each successive period of oscillation, T, will be approximately equal since each period is approximately equal. However, in the case of the non-periodic wave form, as shown in curve 51 of FIG. 17, each successive period of oscillation is not equal. Therefore, the number of high-frequency clock pulses occuring during the period $T_1$ will be very different from the number occurring during the period $T_2$, which in turn will be different from the number occurring during the period $T_3$, etc. If the signal is periodic, as illustrated by curve 50 in FIG. 16, the number of pulses counted in one period will be approximately equal to the number of pulses counted during the next period; whereas, a non-periodic random signal, such as illustrated by curve 51 in FIG. 17, will produce a large difference in te numbe of clock pulses between successive periods.

In order to indicate the presence of a periodic signal when it occurs, a logic 1 can be added to another register each time that two successive periods of the signal are approximately equal. If there is a large degree of periodicity in the signal at the output of the zero-crossing detector 40, as will occur only in the presence of a moving target, then there will be a large number accumulated in the register at the end of a discrete time interval. If only turbulence is present, the output of the zero-crossing detector 40 will be random and non-periodic; therefore, not very many logic 1 values will be addred to the register during the discrete time interval, and the number accumulated in the register at the end of the time interval will be small. The number accumulated in this register will then be repsentative of whether or not a moving target is present. This number, which is the output of the auto-correlator 41 of FIG. 12, is entered into the processor logic circuit 37.

If a moving target is present within the acoustic zone of detection, the signal input to the auto-correlator 41 will be quasi-periodic over a discrete interval of time because a human target will be moving at approximately constant speeds during short discrete intervals of time. The autom-correlator 41 will therefore sample the input signal and detect whether or not it is periodic. The output of the auto-correlator 41 is entered into the processor logic circuit 37, as shown in FIG. 11.

The processor logic circuit 37 will analyze the output of the auto-correlator 41 and determine whether or not there is sufficient periodicity in the signal to activate the alarm circuit 38. Any of the auto-correlators discussed will produce an output signal which is proportional to the number of quasi-circular paths present in the movement of the head of the total rotating phasor during the discrete interval of time that the signal has been sampled.

If the auto-correlator 41 is an analog device, then its output signal can be a voltage proportional to the number of quasi-circular paths present during the sampling interval. The processor logic circuit 37 could then contain a threshold detector 60 such as an op-amp comparator which is well known in the electronic art. The threshold level of the detector is set high enough to disregard any electrical noise transients or any very short term periodicity that might occur due to random conditions. When the output of the auto-correlator 41 exceeds the threshold level, the processor logic circuit 37 will activate the alarm 38.

The processor logic circuit 37 could also include an integrator, such as an R-C low pass filter or an op-amp integrator, as are well known in the electronic art. Without the integrator, the output voltage of the auto-correlator would be small in the presence of a slow moving target because for such a target there would only be a small number of quasi-circular paths present during a short discrete sampling period, and therefore the auto-correlator output voltage might not be sufficient to activate the alarm 38. The integrator will permit the auto-correlator to combine the output voltage levels from several sampling periods of the slow moving target so that the integrated voltage vecomes large enough to activate the alarm circuit 38. With the integrator, the processor logic circuit 37 will be able to discriminate further against transients which do not repeat over several sampling periods.

If the auto-correlator 41 is digital in nature, then the output signal will be a number proportional to the number of quasi-circular paths present in the received signal phasor over the discrete sampling time interval. When the input to the processor logic circuit 37 is a number proportional to the number of quasi-circular paths, it can be stored in the circle detector register 64 and compared with a pre-set reference threshold number stored in a register within the threshold detector 60. As in the analog case, the reference threshold number can be set high enough to ignore digital counts due to transient disturbances. If the input number exceeds the pre-set threshold number, ythe alarm 38 is activated.

The processor logic circuit 37 could also contain a plurality of different threshold numbers stored in separate registers within the threshold detectors 60A and 60B. Any time the auto-correlator exceeds any of the different threshold levels stored in the separate registers, a number is added to the contents of an auxiliary storage register associated with each of the thresholds which have been exceeded. The number added to the separate auxiliary storage registers 62, 62A and 62B could either be the number appearing at the output of the auto-correlator 41, or it could be a logic 1 which simply indicates which of the separate thresholds have been exceeded during the discrete sampling time interva. Secondary threshold numbers could also be stored in the separate registers associated with each separate auxiliary storage register. When the contents of an auxiliary storage register exceeds its secondary threshold number, it indicates that the corresponding total number of quasi-circular paths have existed during the several discrete sampling time intervals, which in turn indicates the presence of a slow moving target. Any transient disturbances will not occur repeatedly over several sampling time intervals, and thus the secondary threshold levels will never be approached without the presence of a moving target. When any of the secondary thresholds are exeeded, a moving target is positively identified and the alarm 38 is activated. The contents of the auxiliary storage registers are periodically reset to zero by the timer and reset pulse generator 63 so that any random transients will not be able to accumulate numbers in the registers over a long period of time.

The various individual digital and analog circuit functions, as well as the several different data porcessing techniques that have been described in the discussion of the auto-correlator 41 and the processor logic circuit 37, are conventional and straightforward and are well known in the electronic art; therefore, they do not separately in themselves form a part of this invention. This invention is only concerned with the novel combination of these elements to achieve immunity to false alarm in the presence of air turbulence and to positively identify a moving target without loss in detection sensitivity of the system.

CIRCLE DETECTOR USING AUTO-CORRELATION OF THE AMPLITUDE OF THE RECEIVED SIGNAL

Figure 13:
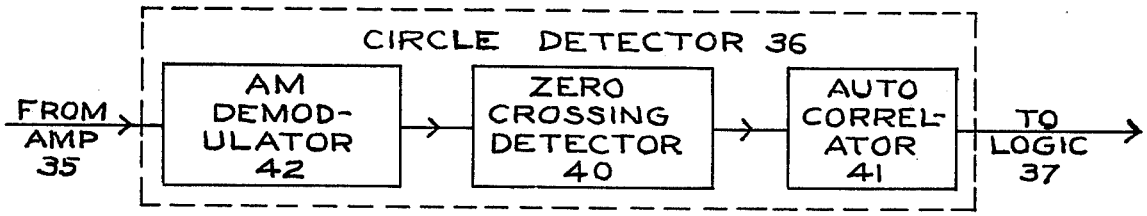
FIG. 13 is a schematic diagram illustrating another design for the circle detector shown in FIG. 11.

FIG. 13 is a schematic block diagram illustrating the use of an AM demodulator and an auto-correlator as the circle detector 36 of FIG. 11. The signal from amplifier 35 is fed into an AM demodulator 42, which may be any of the conventional types well known in the art. For example, it could be a peak detector demodulator as is commonly used in AM radio sets. The output of the AM demodulator 42 is a low-frequency signal corresponding to the changing amplitude of the total rotating phasor which represents the received signal.

As can be seen in FIG. 4, the total rotating phasor 16, in the presence of a moving target, will change in amplitude between the extremes of $|A_S + A_M|$ and $|A_S - A_M|$ at a frequency rate of $\Delta\omega$. The output of the AM demodulator 42 is fed into a zero-crossing detector 40 similar to that used in FIG. 12. The output of the zero-crossing detector will be a constant amplitude signal having an instantaneous frequency corresponding to the instantaneous frequency of the output signal from the AM demodulator 42. The output of the zero-crossing detector 40 is fed into an auto-correlator 41, which is similar to the auto-correlator in FIG. 12.

As was previously discussed in teh ase of the auto-correlation of the phase of the received signal, the signal entering the auto-correlator will only be constant in frequency and similar to curve 50 of FIG. 16 if there is a moving target present. In the presence of air turbulence alone, the input signal to the auto-correlator will change randomly in instantaneous frequency from cycle to cycle as can be seen by the random changes in amplitude as measured in the phasor representing the total received signal plotted in curve 21 of FIG. 9. In the absence of a moving target the output of zero-crossing detector 40 in FIG. 13 will be a random signal similar to that of curve 51 of FIG. 17. The auto-correlator 41 will only respond to an input signal that is essentially constant in frequency, which will occur only in the presence of a moving target which will produce a quasi-circular motion of the head of the total received signal phasor. Thus the operation of this processing circuit is similar to that of the auto-correlator in FIG. 12.

CIRCLE DETECTOR USING CROSS-CORRELATION OF THE PHASE AND AMPLITUDE OF THE RECEIVED SIGNAL

Figure 14:
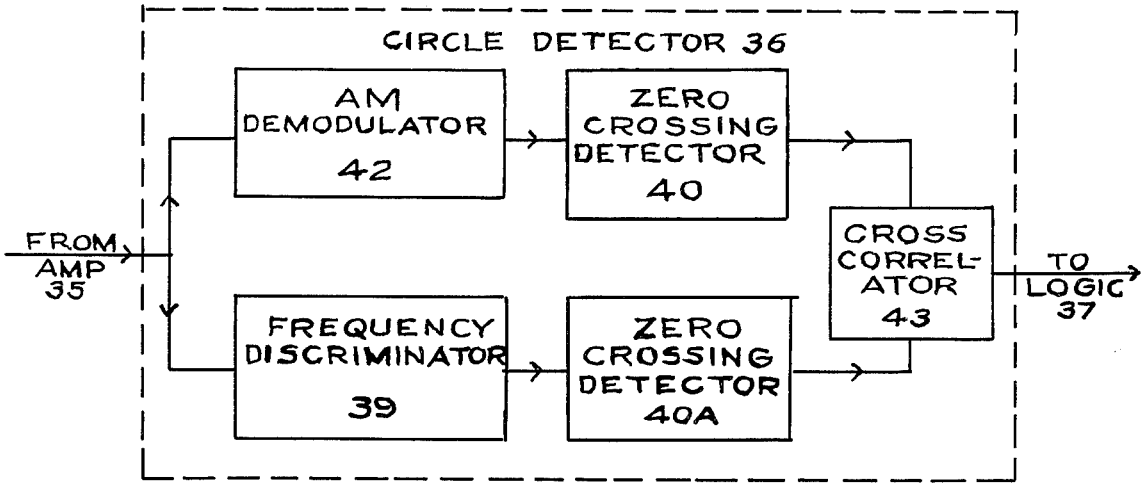
FIG. 14 is a schematic diagram illustrating still another design for the circle detector shown in FIG. 11.

FIG. 14 is a schematic block diagram illustrating the use of an AM demodulator, a frequency discriminator and a cross-correlator as the circle detector 36 of FIG. 11. The signal from amplifier 35 is fed into both an AM demodulator 42 and a frequency discriminator 39. The AM demodulator 42 will produce an output signal corresponding to the change in amplitude of the received signal, while the frequency discriminator 39 will produce an output corresponding to the change in phase of the received signal.

As can be seen from FIG. 4, when a moving target is present, the head of the total received signal phasor, as represented by phasor 16, will be moving in a quasi-circular path at a rate of $\Delta\omega$, which corresponds to the rate of movement of the target. Each time the moving target phasor 15 makes one rotation about the head of the stationary target phasor 14, one cycle of amplitude modulation of the total received signal phasor 16 will be produced. In like manner, each time the moving target phasor 15 makes one rotation about the head of the stationary target phasor 14, one cycle of frequency modulation of the total received signal phasor 16 will also be produced. Therefore, it is obvious that in the presence of a moving target there will be a definite correlation between the output signals from the AM demodulator 42 and from the frequency discriminator 39.

In the presence of only air turbulence, however, as can be seen from curve 21 of FIG. 9, the amplitude and phase of the total received signal phasor will be moving in a random manner with no correlation between the changes in amplitude and the changes in phase of the total received signal. the AM demodulator 42 of FIG. 14 will produce a signal corresponding to the change in amplitude of the total received signal phasor, while at the same time the frequency discriminator 39 will produce a signal corresponding to the change in phase of the total received signal phasor. The outputs from the demodulator 42 and the discriminator 39 are passed through the zero-crossing detectors 40 and 40A and then to the cross-correlator 43, as illustrated in FIG. 14.

Figure 18:
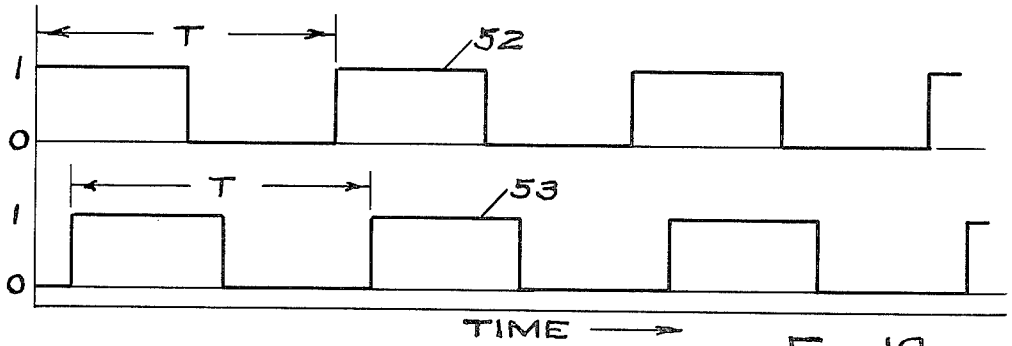
FIG. 18 illustrates the output signals generated by the two zero-crossing detectors of FIG. 14 in the presence of a moving target.

If a moving target is present, the signals at the output of the zero-crossing detectors 40 and 40A in FIG. 14 will appear as illustrated in FIG. 18. Curve 52 shows the output of the zero-crossing detector 40 and represents the amplitude demodulated signal. The signal represented by curve 52 is periodic with a period T, as defined in equation (11). One complete period will be produced each time the moving target phasor 15 of FIG. 4 makes one complete revolution about the stationary target phasor 14. Curve 53 shows the output of the zero-crossing detector 40A in FIG. 14 and represents the frequency demodulated signal. This signal is also periodic and has the same period T as curve 52.

Although curves 52 and 53 have the same periods T, their relative phases are not necessarily the same. The phase difference is illustrated by the displacement of the two curves shown in FIG. 18. The shift in phase occurs because the minimum and maximum values of the amplitude of the total received signal phasor 16 occur at different times than the minimum and maximum values of the phase, as is evident in FIG. 4.

Figure 19:
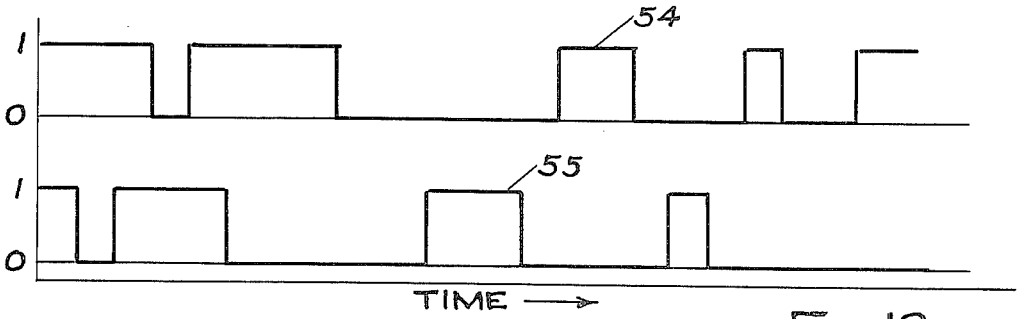
FIG. 19 illustrates the output signals generated by the two zero-crossing detectors of FIG. 14 in the presence of only air turbulence.

If only air turbulence is present, both the amplitude and phase of the total received signal phasor will vary in a random manner, as illustrated by curve 21 in FIG. 9. For this condition, the outputs of the zero-crossing detectors 40 and 40A in FIG. 14 will have random wave forms, as illustrated in FIG. 19. Curve 54 shows the output of the zero-crossing detector 40 in FIG. 14 and represents the amplitude demodulated signal. Curve 55 shows the output of the zero-crossing detector 40A and represents the frequency demodulated signal. As can be seen in FIG. 19, both these wave forms are random and contain no correlation between each other.

The outputs of the zero-crossing detectors 40 and 40A in FIG. 14 are fed to the cross-correlator 43. A cross-correlator is a device which compares two input signals and responds when the instantaneous frequencies of the two signals are equal. Corss-correlators may employ either analog or digital circuitry. If an analog system is employed for the cross-correlator 43 in FIG. 14, the zero-crossing detectors 40 and 40A may be omitted and the output signals from the AM demodulator 42 and the frequency discriminator 39 may be fed directly to the cross-correlator 43. For such a system to cross-correlator may consisto of a conventional analog multiplier and an integrating circuit.

A digital method for accomplishing the cross-correlation illustrated in FIG. 14 will utilize the zero-crossing detectors 40 and 40A as shown. The output of the zero-crossing detectors will be square wave signals which alternately switch between logic levels 0 and 1 as shown by the curves in FIGS. 18 and 19. The outputs of the two zero-crossing detectors are fed into the cross-correlator 43. One embodiment of the cross-correlator may consist of two auto-correlators similar to the auto-correlator 41 of FIGS. 12 and 13 in combination with an AND gate. The output of zero-crossing detector 40 is fed to one of the auto-correlators and the output from the zero-crossing detector 40A is fed to the other auto-correlator. The outputs from the two auto-correlators are fed into the AND gate. The AND gate will respond only when there is a simultaneous output signal from both auto-correlators which, in turn, indicates that periodicity exists in the output signals from both the AM demodulator 42 and the frequency discriminator 39. This common periodicity will only occur when there is circular motion in the head of the total received signal phasor which, in turn, can only take place in the presence of a moving target.

Another embodiment of the cross-correlator 43 could make use of a sequence detector, which is a device that recognized changes of state in each of two signals and responds only when the changes in state occur alternately between the two signals. Curves 52 and 53 of FIG. 18, which represent the outputs of the zero-crossing detectors 40 and 40A in the presence of a moving target, show the changes in state as they occur alternately between the two signals. A sequence detector can be easily built by anyone skilled in the art utilizing conventional digital circuit design. A preferred design of the sequence detector to perform the function of the cross-correlator 43 will add a logic 1 to a register each time that the output signal from the zero-crossing detector 40 changes state following a change of state of the signal from the zero-crossing detector 40A. A logic 1 will also be added to the register each time that the output signal from the zero-crossing detector 40A changes state following a change of state of the signal from the zero-crossing detector 40. Whenever either the zero-crossing detector 40 or 40A change state two or more successive times without the other zero-crossing detector changing state, a logic 1 is subtracted from the register.

In the presence of a moving target, the signal output from the zero-crossing detectors 40 and 40A will result in the accumulation of a large positive number in the register during a discrete interval of time. In the absence of a moving target, and with only air turbulence present, the signal outputs from the zero-crossing detectors will be random in nature as shown in FIG. 19. For this condition, a relatively large number of logic 1 values are subtracted from the register, while a corresponding relatively large number are also being added to the register, which results in the net accumulation of a relatively small number in the register during a discrete interval of time. When there is a large positive number accumulated in the register after a discrete interval of time, the logic circuit 37 in FIG. 11 will determine that a moving target is present and will activate the alarm 38.

Figure 20:
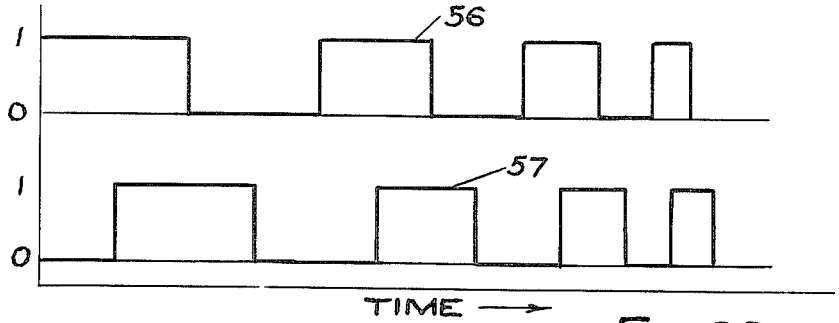
FIG. 20 illustrates the output signals generated by the two zero-crossing detectors of FIG. 14 in the presence of target moving at a non-uniform velocity.

The use of cross-correlation in the signal processing has an advantage over the use of auto-correlation. Auto-correlation requires that the target is moving at a constant velocity during a discrete interval of time whereas cross-correlation does not have this limitation. If the velocity of a moving target is varying, then the moving target phasor 15 of FIG. 4 will be spinning at a corresponding varying rate. This will cause the outputs of the zero-crossing detectors 40 and 40A of FIG. 14 to be square waves of varying frequency. Such a situation is represented by curves 56 and 57 in FIG. 20. Even though there is no periodicity in either of these two wave forms, there is a cross-correlation between the two signals because, as can be seen, the changes in state are occurring alternately between the signals which indicates that there is quasi-circular motion present in the head of the total received signal phasor. A cross-correlator such as the sequence detector described above will detect the presence of this quasi-circular motion.

Figure 15:
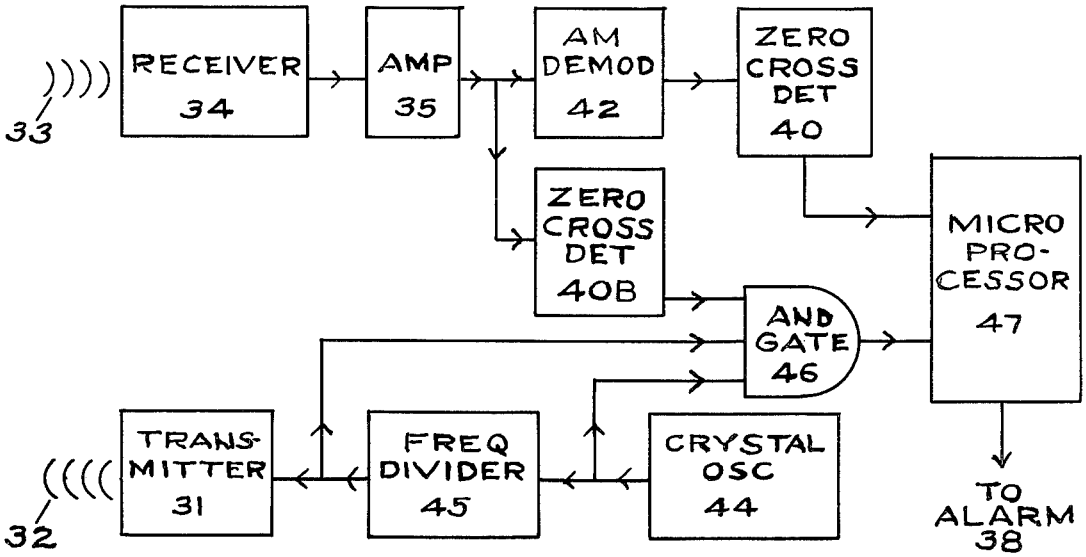
FIG. 15 is a schematic diagram illustrating the use of a microprocessor in the improved intrusion alarm system employing the teachings of this invention.

Another method of implementing the circle detector 36 is shown in FIG. 15. A high frequency crystal oscillator 44, preferably operating in the megahertz region, is divided down by the frequency divider 45 to produce an ultrasonic signal for driving the ultrasonic transmitter 31 which transmits an ultrasonic acoustic signal 32. The ultrasonic frequency is preferably chosen in the range between 20 kHz and 40 kHz. The received acoustic signal 33 is converted to an electrical signal by the receiver 34 and then amplified by amplifier 35. The amplified signal is fed into an AM demodulator 42 and the demodulator output is fed into a zero-crossing detector 40. The output of amplifier 35 is also fed directly into another zero-crossing detector 40B, whose output is fed into the AND gate 46. The AND gate 46 also receives an output signal directly from the crystal oscillator 44 and another input signal from the frequency divider 45 as shown.

The output of the zero-crossing detector 40B is a square wave replica of the received signal, and the output of the frequency divider 45 is a square wave replica of the transmitted signal. In a quiet area where there is no target movement or air turbulence, the received signal will be exactly equal in frequency to the frequency of the transmitted signal; but the phase of the signal will be at some arbitrary value depending on the location of the stationary targets. These two signals of equal frequency but different phase will appear similar to the curves 52 and 53 shown in FIG. 18, except that the frequencies will be in the ultrasonic range, typically between 20 kHz and 40 kHz. During the period of time that both the output of the frequency divider 45 and the output of the zero-crossing detector 40B are high, the high frequency pulses from the crystal oscillator 44 will pass through the AND gate 46. Since there is no change in relative phase between the output of the zero-crossing detector 40B and the output of the frequency divider 45, the number of high frequency pulses passing through the AND gate 46 during each period of the transmitted frequency will be constant.

When there is a moving target present, the phase of the total received signal phasor 16 will increase and decrease relative to the phase of the transmitted signal at a rate $\Delta\omega$ as shown in FIG. 4. As the received signal changes in phase, the output of the zero-crossing detector 40B will change in phase relative to the output of the frequency divider 45. For this condition the number of high frequency pulses passing through the AND gate 46 during each period of the transmitted frequency will vary as a function of the change in phase.

The output of the AND gate 46 is entered into a microprocessor 47. A microprocessor is an integrated circuit computer which can be programmed similar to any general purpose digital computer to analyze data presented to it in "real time". A microprocessor, as is well known, can replace many discrete digital circuit elements and it can be programmed to perform the functions of the many discrete circuit elements which it replaces. Therefore, the microprocessor 77 can be programmed to count and store the number of high frequency pulses appearing at the output of the AND gate 46 during successive periods of the transmitted frequency. The changes in the number of high frequency pulses appearing during successive periods of the transmitted frequency will be proportional to the changes in phase occurring during the periods between the transmitted signal 32 and the received signal 33. It is therefore possible to program the microprocessor 77 to include the function of comparing the number of high frequency pulses appearing during the successive periods, and thus accomplish the same basic function as was performed by the frequency discriminator 39 in FIGS. 12 and 14.

The microprocessor 47 also receives the output signal from the zero-crossing detector 40 which contains the amplitude demodulated information. This signal is the same as the output signal appearing at the output of the zero-crossing detector 40 illustrated in the circle detector schematic diagrams of FIG. 13 and FIG. 14. The microprocessor, therefore, has available to it the same amplitude and frequency information that was fed to the auto-correlator 41 in FIGS. 12 and 13 and to the cross-correlator 43 in FIG. 14. Thus the microprocessor can easily be programmed to perform the functions of the various embodiments of the circle detector 36 previously described, and in particular it can perform the functions of either the auto-correlator 41 of FIGS. 12 and 13 or the cross-correlator 43 of FIG. 14.

The output of the circle detector, as previously described, is a number which is proportional to the number of quasi-circular paths which occur in the head of the total received rotating phasor during a discrete increment of time. This number can be easily stored in a register in the memory of the microprocessor which may be identified as the circle detector register. The microprocessor 47 can then be used in a variety of ways to perform the function of the logic circuit 37 of FIG. 11. For example, a threshold number may be stored in another register in memory which may be identified as the first threshold register. At the end of each sampling period the number appearing in the circle detector register is compared to the number contained in the first threshold register. The threshold number is chosen such that it is below the number of quasi-circular paths which accumulate in the circle detector register when a moving target is present during the sampling period. The threshold number must also be high enough so that it not be exceeded by an occasional count that gets into the register due to a transient disturbance from any source. If the number stored in the threshold register is exceeded by the number appearing in the circle detector register, it will indicate the presence of a moving target and the alarm circuit 38 is activated.

During several experimental verification tests which Applicant conducted to confirm the fundamental mathematical analyses and conclusions that have been disclosed in this application, a number of experimental systems were built which included the different processing systems illustrated in FIGS. 12, 13, 14 and 15. While testing the various experimental systems Applicant found it possible to further improve the reliability of the inventive system for recognizing the presence of the quasi-circular paths generated by the head of the rotating phasor which represents the received signal when a moving target is present. The additional improvement is achieved by providing in the memory of the microprocessor a plurality of different threshold levels which are lower than the single threshold level set in the first threshold register described above. With the use of only a single threshold level, even though provision can be made for adjusting or selecting the magnitude of the threshold level to best accommodate the particular enivronmental conditions of the installation, there is a degree of uncertainty in the determination of what the best single value of threshold setting should be for the system to have maximum reliability and to ignore all transient disturbances while at the same time recognize all moving targets even when they are moving at abnormally low speeds.

A detailed discussion will follow to illustrate how a plurality of different threshold levels may be used to achieve additional improvement in the motion detection reliability of the inventive system, even though the inventive system as described has already been tested under severe environmental conditions and found to be vastly superior to contemporary prior art systems. The discussion will include actual experimental data recoreded during hundreds of hours of testing under varying environmental condition including very high air turbulence and also with sophisticated targets moving slowly in a manner that easily avoided detection in all contemporary commercially available art systems that were comparatively tested within the same test zone.

An experimental processing system was built incorporating the circuit schematically illustrated in FIG. 15 and for the most difficult environmental conditions that could be created in the testing area (including a large high speed pedestal fan which generated abnormally high air turbulence) a threshold level setting of 20 counts in the first threshold register was found satisfactory and was never breached during 90 hours of continuous operation without the presence of a moving target under the severe environmental test conditions that were continuously maintained throughout the entire test period. As soon as an individual entered the test zone with or without the severe environmental conditions present, the circle detector register would immediately indicate counts ranging from 40 to well over 100, thus giving positive and reliable indication of the presence of the moving target because the circle detector generated much larger counts (in excess of 40) during the incremental sampling time periods in the presence of the moving target than the threshold level setting of 20 counts that was stored in the first threshold register. However, with the advantage of having full knowledge of the operating characteristics of the inventive experimental system Applicant found it possible to move about at a very slow unnatural hesitating pace with his body held rigid and his arms held fixed against his sides to prevent arm motion. Under such abnormal conditions the circle detector output could be made to occasionally register counts somewhat lower than 20 for very brief periods of time and thus avoid detection during these brief periods by not exceeding the threshold setting of 20 counts in the first threshold register.

During the 90-hour test period of continuous operation of the experimental inventive system under the indicated severe environmental conditions, large quantities of comprehensive data were recorded to show the frequency of occurrence of the different number of counts that would appear in the circle detector register in the absence of a moving target during the many hundreds of thousands of discrete small intervals of time for which the data was being recorded. These data revealed that for more than 99.8% of the time during the entire continuous 90-hour test period the number of counts appearing in the circle detector register during any discrete interval of time was less than 10 for all existing conditions of air turbulence and electrical and acoustic transients. The largest count recorded among 100% of all the discrete intervals of time during the total 90-hour test period was 18 (which number actually appeared only once during the entire test period). A very few random counts occurred during the 90 hours with numbers ranging between 10 and 17. The total number of these few infrequent occurrences during the 90-hour period are relatively less the higher the count number.

In order to eliminate the remote possibility of not recognizing a moving target, even if only for a brief period during which an abnormally and an unlikely slow rate of movement of the target is taking place such as described above, a plurality of secondary lower threshold levels may be used in the microprocessor memory. For example, in addition to the threshold number 20 that is stored in the first threshold register, a threshold number 15 and threshold number 10 can be stored in separate secondary threshold registers which will be designated as register 15 and register 10 respectively. Then whenever the number of counts appearing in the circle detector register occasionally exceeds 10 or 15 in the presence of severe ambient conditions, the microprocessor is programmed not to activate the alarm circuit 38 upon the infrequent breaching of these secondary thresholds, but instead a number will be added to another set of auxiliary registers associated with the secondary registers that are breached. For example, each time the accumulated number in the circle detector register exceeds 10, a one is added to the auxiliary register associated with the secondary register 10. Each time the number in the circle detector register exceeds 15, a one is added to the auxiliary register associated with the secondary register 15. Then, if the value stored in the auxiliary register associated with the secondary register 15 exceeds a predetermined value such as, for example, 2, within a predetermined time period, or if the value stored in the auxiliary register assoicated with the secondary register 10 exceeds a higher value such as, for example, 3, the alarm circuit 38 is activated. This means that if a number appears in the circle detector register greater than 20, for example, if will immediately activate the alarm. However, when a number greater than 15 appears, it must appear twice within the predetermined time period in order to activate the alarm; or when a number greater than 10 appears it must appear three times within the predetermined time period in order to activate the alarm. The auxiliary registers associated with the secondary registers 10 and 15 are reset to zero at the end of each predetermined time period to prevent the accumulation of the infrequent occasional counts that appear in the auxiliary registers. This will prevent any sporadic infrequent count that breaches the secondary threshold registers as a result of very severe environmental disturbances from activating the alarm.

During the experimental tests Applicant found that the use of a predetermined time period ranging approximately between 15 to 30 seconds was adequate to achieve immunity from false alarms without sacrifice in moving target detection sensitivity. The use of the secondary thresholds as described removes the threshold setting uncertainty that is inherent in a single threshold system. Another advantage in the use of the multiple threshold registers is that complete discrimination can be achieved from false alarms due to air turbulence and noise transients without reducing the system sensitivity for detecting moving targets even while moving at abnormally slow rates of speed. The use of multiple threshold registers as described also eliminates the need for providing adjustable sensitivity controls such as are presently required by all contemporary state of the art intrustion detection systems.

The vastly superior performance of the inventive intrusion detection system over all prior art systems results beecause of the departure from prior art concepts on the fundamental principles of operation and design of Doppler intrusion alarm systems. The breakthrough in system performance as disclosed in this application has been achieved by Applicant's mathematical discovery of the presence of circular motion which exists in the locus of the head of the rotating phasor which represents the received signal in a Doppler intrusion alarm system when a moving target is present, and on the virtual absence of circular motion when a moving target is absent regardless of environmental disturbances such as air turbulence and noise transients. Applicant has experimentally confirmed the validity of his mathematical conclusions and has presented a comprehensive disclosure of his findings in this application. The invention makes use of these new findings in combination with a new signal processing system which incorporates a circle detector, as disclosed, for recognizing the presence of circular motion in the head of a rotating phasor when it occurs in the received signal, thus permitting absolute detection of a moving target even in the presence of environmental disturbances such as air turbulence while the system remains immune to false alarms due to these disturbances. The use of digital circuitry eliminates the need for sensitivity controls such as are required in prior art systems, thereby insuring correct installation of the inventive system with maximum reliability of operation.

The specific design details of the separate individual well known circuit functions which Applicant has used in new combinations to create a circle detector are not in themselves a part of this invention. Several designs have been described only to indicate the many possibilities that are well known in the art for providing specific circuitry to perform the various individual functions which are used in new combinations in the design of a circle detector. This invention is primarily concerned with the novel application of a circle detector in a new Doppler intrusion alarm system for indicating the presence of circular paths in the received signal whenever a moving target is present. The new inventive system achieves enormous improvement in reliability of performance and immunity to false alarms over the prior art.

The novel use of digital circuits with a plurality of threshold registers with different threshold level settings stored in memory, as disclosed, gives unprecedented immunity to false alarms in the presence of air turbulence and other environmental transient disturbances without any reduction in moving target detection capability. The inventive signal processing system permits the elimination of all sensitivity controls, thus removing the largest installation problem faced by contemporary prior art Doppler systems which require sensitivity adjustments to be made to reduce false alarms in the presence of environmental disturbances which, in turn, results in decreased detection capability for slow moving targets.

Applicant has described several alternative means for applying the new teachings disclosed in this invention for achieving enormous improvement over the prior art in the reliability of operation of Doppler intrusion detection systems. It will be obvious to those skilled in the art that numerous departures may be made from the details shown. Therefore, the invention should not be limited to the specific equipment shown and described herein. Quite the contrary, the appended claims should be construed to cover all equivalents falling within the true spirit of the invention.

I claim:

1. In an intrusion alarm system, means for radiating a signal at a predetermined frequency into space, means for receiving the signal as it is reflected from a plurality of objects within the space, said received signal characterized in that it may be represented by a rotating phasor, said rotating phasor characterized in that it is the summation of a plurality of individual rotating component phasors, each representing a reflected signal from one of said plurality of objects, said rotating component phasors further characterized in that they represent two groups of reflected signals, a first group reflected from stationary objects, and a second group reflected from moving objects, said first group of reflected signals characterized in that they are represented by rotating component phasors whose average frequency of rotation is equal to the frequency of the transmitted signal, said second group of reflected signals characterized in that they are represented by rotating component phasors whose average frequency of rotation is different from the frequency of the transmitted signal by amounts corresponding to the rates of movements of said objects, said total rotating phasor further characterized in that the locus of the head of said total rotating phasor describes a quasi-circular path relative to the head of the summation of said first group of rotating component phasors, signal processing means for processing said received signal, said signal processing means including a circle detector for recognizing the presence of said quasi-circular paths in said total rotating phasor when they appear.

2. The invention in claim 1 further characterized in that said signal processing means includes a first additional means for making measurements over discrete increments of time and a second additiona means for determining the number of quasi-circular paths that are recognized in said rotating phasor during said discrete increments of time.

3. The invention in claim 2 further characterized in that said signal processing means includes a third additional circuit means for determining when the number of quasi-circular paths recognized during said discrete intervals of time exceeds a reference threshold value.

4. The invention in claim 3 further characterized in that said signal processing means includes alarm activating means responsive to the presence of said quasi-circular paths in the measured signal when their number during a discrete interval of time exceeds said reference threshold value.

5. The invention in claim 3 further characterized in that said signal processing means includes a plurality of said third additional circuit means, each having a different reference threshold value for separately and individually determining when the number of quasi-circular paths recognized during said discrete intervals of time exceeds each of said different reference threshold values.

6. The invention in claim 5 further characterized in that said signal processing means also includes a plurality of signal storage means, one storage means associated with each one of said plurality of said third additional circuit means, each storage means adapted for separately accumulating data to indicate each time the number of recognized quasi-circular paths exceeds each different reference threshold value in each separate third additional circuit means.

7. The invention in claim 6 further characterized in that each signal storage means includes a different additional threshold value and additional data processing means for determining when stored data in each storage means exceeds each different additional threshold value as set for each separate signal storage means.

8. The invention in claim 7 further characterized in that said signal processing means includes alarm activating means responsive to the breaching of any one of said different additional threshold values.

9. The invention in claim 8 characterized in that said breaching of said different additional threshold values take place within a predetermined period of time.

10. The invention in claim 6 further characterized in that said signal processing means includes alarm activating means, and still further characterized in that said signal processing means includes means for comparing the accumulated data stored in each of said plurality of signal storage means and still further characterized in that said alarm activating means is responsive to a particular combination of the quantities of stored data separately accumulated in each of said plurality of said signal storage means over a predetermined period of time.

11. The invention in claim 3 and additional means for adjusting the magnitude of said reference threhold value.

12. The invention in claim 1 further characterized in that said signal is ultrasonic.

13. The invention in claim 12 further characterized in that the frequency of said ultrasonic signal lies within the approximate frequency range 20 kHz to 40 kHz.

14. The invention in claim 1 characterized in that said signal processing means includes digital circuitry and further characterized in that said signal processing means also includes a circle detector register adapted for counting the number of quasi-circular paths which appear at the output of the circle detector during discrete intervals of time, said signal processing means also includes a plurality of threshold registers characterized in that each threshold register has a different reference threshold value, a plurality of auxiliary registers, one auxiliary register associated with each of said plurality of threshold registers, said signal processing means further characterized in that it includes means for adding an individual count to an auxiliary register whenever its associated threshold register is breached, and alarm activating means responsive to a specific number of counts accumulated in each of said plurality of auxiliary registers during a predetermined time period, and specific number of counts being relatively greater for the auxiliary register associated with the lower threshold level register.

15. The invention in claim 14 further characterized in that said predetermined time period is greater than 10 seconds.

16. The invention in claim 14 and additional means for clearing and resetting said auxiliary registers after each predetermined time period.

17. The invention in claim 14 further characterized in that said signal processing means includes a microprocessor.

18. The invention in claim 14 further characterized in that said signal processing means includes a precision oscillator in the megaHertz region.

* * * * *